US011412318B2

(12) United States Patent
Peng et al.

(10) Patent No.: US 11,412,318 B2
(45) Date of Patent: Aug. 9, 2022

(54) VIRTUAL REALITY HEAD-MOUNTED DISPLAY DEVICE

(71) Applicant: PEGATRON CORPORATION, Taipei (TW)

(72) Inventors: Te-Yuan Peng, Taipei (TW); Chieh-Chun Kang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 17/204,470

(22) Filed: Mar. 17, 2021

(65) Prior Publication Data

US 2021/0337288 A1 Oct. 28, 2021

(30) Foreign Application Priority Data

Apr. 28, 2020 (TW) ..... 109114207

(51) Int. Cl.
*H04R 1/02* (2006.01)
*H04R 1/32* (2006.01)

(52) U.S. Cl.
CPC ..... *H04R 1/025* (2013.01); *H04R 1/323* (2013.01); *H04R 2499/15* (2013.01)

(58) Field of Classification Search
CPC ..... H04R 1/025; H04R 1/323; H04R 2499/15
USPC ..... 381/333
See application file for complete search history.

(56) References Cited

U.S. PATENT DOCUMENTS 9,826,299 B1 11/2017 Osterhout et al.
9,880,441 B1 1/2018 Osterhout
10,878,775 B2 12/2020 Haddick
2010/0238396 A1* 9/2010 Jannard ..... H04M 1/05 381/381
2010/0253904 A1* 10/2010 Jannard ..... G02B 27/017 351/158
2013/0127980 A1* 5/2013 Haddick ..... G02B 27/0093 348/14.08
2014/0270316 A1* 9/2014 Fan ..... G02C 11/10 381/381
2017/0235335 A1* 8/2017 Miller ..... H04R 1/028 381/334
2018/0035101 A1 2/2018 Osterhout
2018/0255386 A1* 9/2018 Bristol ..... H04R 1/1066

FOREIGN PATENT DOCUMENTS

WO WO-2017/151872 A1 9/2017

* cited by examiner

*Primary Examiner* — Sean H Nguyen

(74) *Attorney, Agent, or Firm* — Muncy, Geissler, Olds & Lowe, P.C.

(57) ABSTRACT

The application discloses a virtual reality (VR) head-mounted display (HMD) device, and the VR HMD is worn on a head of a user, and includes a body and a fixing assembly. The fixing assembly includes a support arm set, two pivot pieces and two audio elements. The support arm set has a first end portion and a second end portion respectively located on two opposite sides of the body. The two pivot pieces are respectively connected to the first end portion and the second end portion, and are respectively pivotally connected to the two opposite sides of the body. The two audio elements are respectively disposed between the first end portion and one of the two pivot pieces and between the second end portion and another of the two pivot pieces. Each of the two audio elements has a sound guide hole facing an ear of the user.

12 Claims, 4 Drawing Sheets

VIRTUAL REALITY HEAD-MOUNTED DISPLAY DEVICE

CROSS-REFERENCE TO RELATED APPLICATION

This application claims the priority benefit of Taiwan application no. 109114207, filed on Apr. 28, 2020. The entirety of the above-mentioned patent application is hereby incorporated by reference herein and made a part of this specification.

BACKGROUND

Technical Field

The application relates to a virtual reality display device, and in particular, to a head-mounted display device.

Related Art

Virtual reality (VR) display technologies generally use head-mounted displays (HMDs) as display devices of stereoscopic images. The HMD generally has an eye patch (a body), to cover the front of eyes of a user, and completely block views of the user, so that the user can be immersed in visual effects of the VR created by displayed images.

In addition to the visual effects of the images, auditory effects are also one of the important factors that affect whether the user can be immersed in a situation. Currently, an audio module of an HMD is disposed inside the eye patch, a sound guide element is additionally disposed on two sides of the eye patch, and the element is usually an elongated element with a hollow channel. However, after the played sound passes through the sound guide elements, the audio effects are reduced. In addition, positions of the current sound guide elements cannot be adjusted. As a result, sound-output directions of the sound guide elements cannot match positions of ears of different users.

SUMMARY

In view of the foregoing subject, a main objective of the application is to provide a virtual reality (VR) head-mounted display (HMD) device, to resolve problems that the conventional HMD device has poor auditory effects and cannot be adjusted according to different users.

To achieve the foregoing objective, the application provides a VR HMD device, worn on a head of a user. The VR HMD device includes a body and a fixing assembly. The fixing assembly includes a support arm set, two pivot pieces and two audio elements. The support arm set has a first end portion and a second end portion respectively located on two opposite sides of the body. The two pivot pieces are respectively connected to the first end portion and the second end portion, and are respectively pivotally connected to the two opposite sides of the body. The two audio elements are respectively disposed between the first end portion and one of the two pivot pieces and between the second end portion and another of the two pivot pieces. Each of the two audio elements has a sound guide hole, and the sound guide hole faces an ear of the user.

According to an embodiment of the application, the fixing assembly further includes an adjustment mechanism, the support arm set has an overlapping region, the overlapping region is located between the first end portion and the second end portion, and the adjustment mechanism is disposed on the overlapping region, to adjust an overall length of the support arm set.

According to an embodiment of the application, the adjustment mechanism includes a gear, and the support arm set includes a first arm and a second arm. The first arm has a first end portion and a first gear rack portion, and the second arm has a second end portion and a second gear rack portion. At least a part of the first gear rack portion and at least a part of the second gear rack portion are located on the overlapping region and overlap each other and are engaged with the gear.

According to an embodiment of the application, when the gear rotates, the first gear rack portion and the second gear rack portion are driven to move relatively, to change an overlapping length of the first gear rack portion and the second gear rack portion, to adjust the overall length of the support arm set.

According to an embodiment of the application, the first gear rack portion is located at an end of the first arm opposite to the first end portion, and the second gear rack portion is located at an end of the second arm opposite to the second end portion.

According to an embodiment of the application, the adjustment mechanism further includes a knob connected to the gear and configured to drive the gear.

According to an embodiment of the application, the support arm set has two first accommodation slots, respectively located at the first end portion and the second end portion, and the two audio elements are respectively disposed in the two first accommodation slots.

According to an embodiment of the application, each of the pivot pieces has a second accommodation slot corresponding to the first accommodation slot, each of the audio elements is accommodated in the first accommodation slot and the second accommodation slot, and the sound guide hole is in communication with the outside.

According to an embodiment of the application, the first accommodation slot or the second accommodation slot has an opening, and the opening is in communication with the sound guide hole.

According to an embodiment of the application, the two audio elements are respectively disposed between the first end portion and one of the two pivot pieces and between the second end portion and another of the two pivot pieces in a pivot manner, so that the two audio elements respectively rotate relative to the first end portion and the second end portion.

According to an embodiment of the application, each of the two opposite sides of the body includes a pivot portion, each of the pivot pieces includes a pivot hole, and the pivot piece is assembled to the pivot portion by the pivot hole.

Based on the above, because the sound guide holes of the audio element face ears of the user, sound may be clearly transmitted to the ears of the user, and the support arm set is connected to the body through the pivot pieces, so that directions of the sound guide holes may further be adjusted by rotating the support arm set, to match ear positions or usage habits of different users. Moreover, the user may also rotate the gear by rotating the knob, to adjust the overall length of the support arm set.

DETAILED DESCRIPTION

To enable the examiner to understand the technical content of the application better, descriptions of specific preferred embodiments are provided below particularly.

Figure 1:
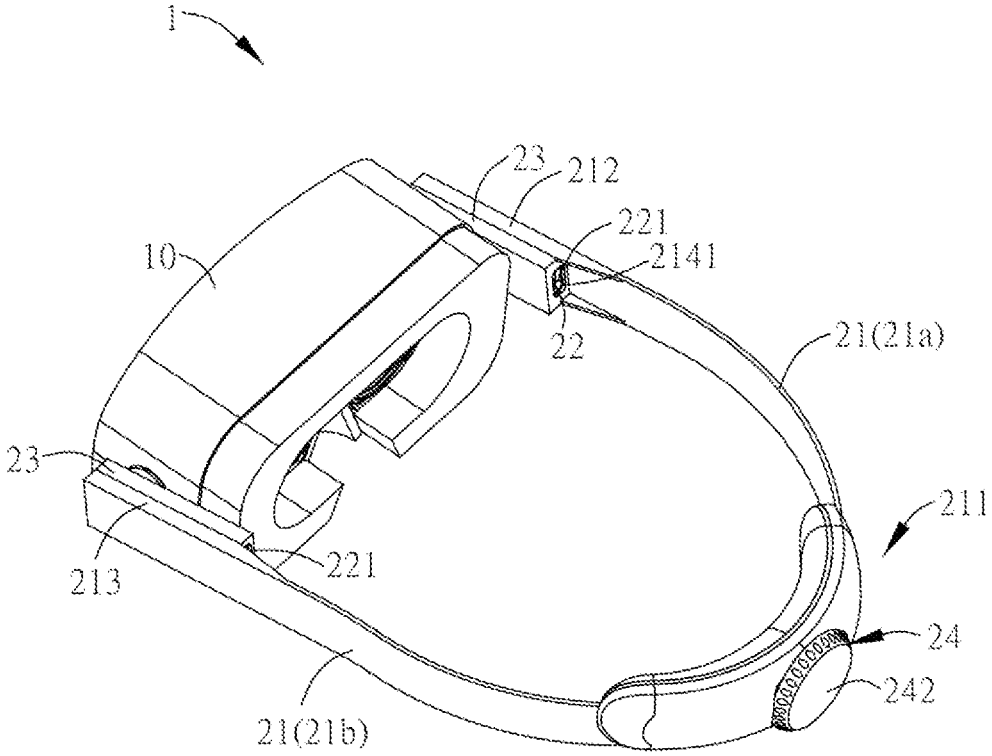
FIG. 1 is a schematic diagram of a virtual reality (VR) head-mounted display (HMD) device according to an embodiment of the application.
Figure 2:
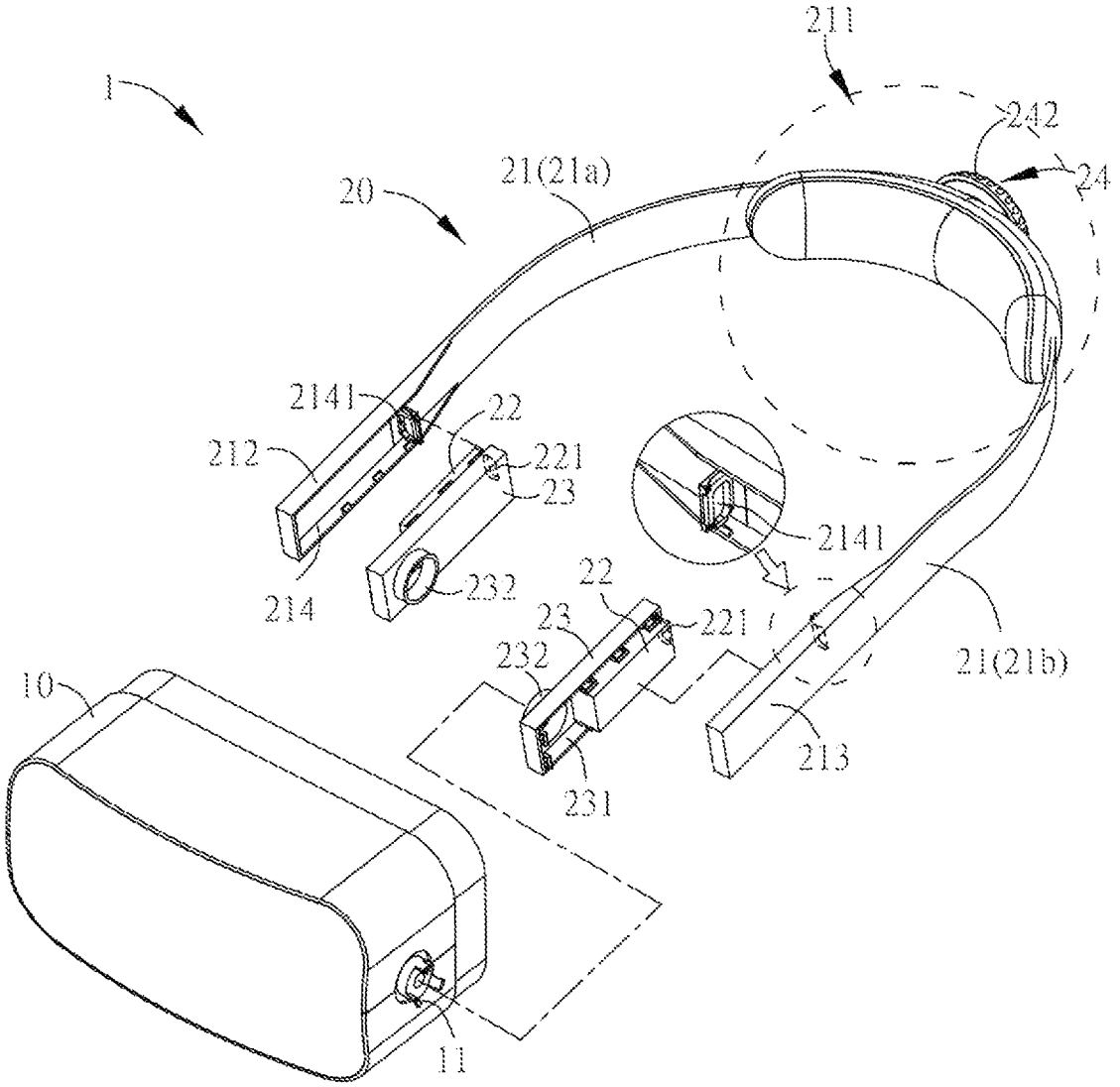
FIG. 2 is a schematic exploded diagram of the VR HMD device shown in FIG. 1.
Figure 3A:
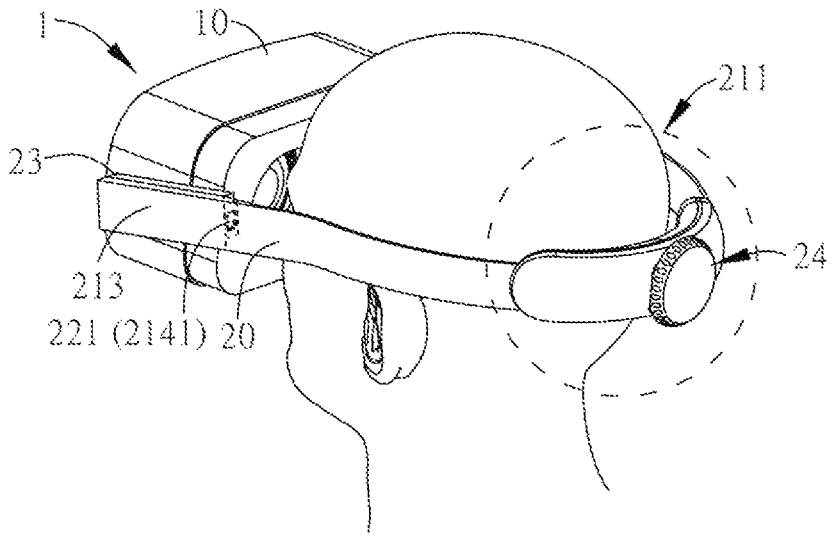
FIG. 3A and FIG. 3B are schematic diagrams of wearing the VR HMD device shown in FIG. 1.
Figure 3B:
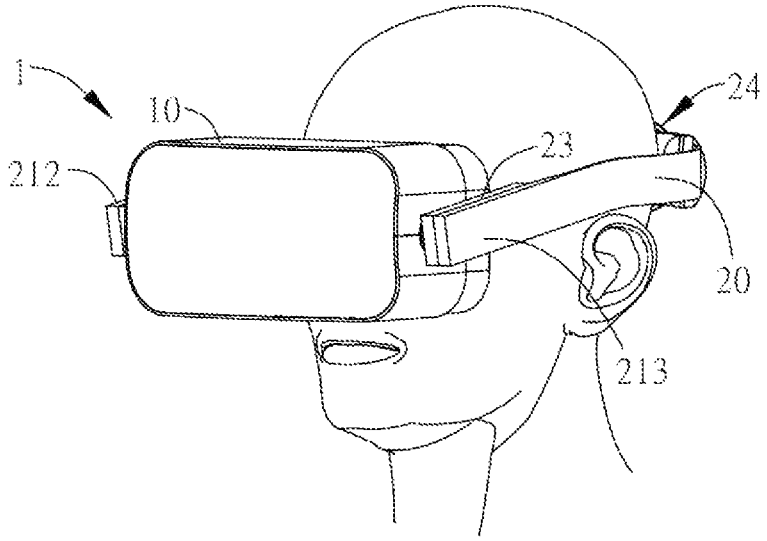

FIG. 1 is a schematic diagram of a virtual reality (VR) head-mounted display (HMD) device according to an embodiment of the application, FIG. 2 is a schematic exploded diagram of the VR HMD device shown in FIG. 1, and FIG. 3A and FIG. 3B are schematic diagrams of wearing the VR HMD device shown in FIG. 1. Referring to FIG. 1, FIG. 2, FIG. 3A and FIG. 3B, A VR HMD device 1 (hereinafter referred to as HMD device 1) of this embodiment is worn on a head of a user, as shown in FIG. 3A and FIG. 3B. The HMD device 1 includes a body 10 and a fixing assembly 20. The body 10 of this embodiment is an eye patch configuration, and a display module is disposed inside to present virtual visual images. The fixing assembly 20 includes a support arm set 21, two audio elements 22 and two pivot pieces 23. The support arm set 21 may also be referred to as a bandage, the support arm set 21 of this embodiment has an overlapping region 211, and a first end portion 212 and a second end portion 213 respectively located on two opposite sides of the body 10. It should be noted that the first end portion 212 and the second end portion 213 refer to regions located at the support arm set 21 close to the two opposite ends of the body 10, but not refer to end surfaces close to the two opposite ends of the body 10. In addition, the overlapping region 211 is located between the first end portion 212 and the second end portion 213.

The audio elements 22 are respectively disposed between the first end portion 212 and one of the two pivot pieces 23 and between the second end portion 213 and another of the pivot pieces 23. Preferably, the support arm set 21 has two first accommodation slots 214 respectively located at the first end portion 212 and the second end portion 213 (because of the perspective of FIG. 2, the first accommodation slot 214 located at the second end portion 213 is not shown), and the two audio elements 22 are respectively disposed in the two first accommodation slots 214. In addition, the two pivot pieces 23 are respectively connected to the first end portion 212 and the second end portion 213, and the two pivot pieces 23 are pivotally connected to the two opposite sides of the body 10. In other words, the support arm set 21 of this embodiment is connected to the two opposite sides of the body 10 through the pivot pieces 23. When the pivot pieces 23 are pivotally connected to the body 10, both the audio element 22 and the support arm set 21 may rotate relative to the body 10, to adjust different wearing angles.

Preferably, each pivot piece 23 of this embodiment has a second accommodation slot 231 and a pivot hole 232. The second accommodation slot 231 and the first accommodation slot 214 correspond to each other. After being assembled, the first accommodation slot 214 and the second accommodation slot 231 have space for accommodating the audio elements 22, so that the audio elements 22 may be accommodated in the first accommodation slot 214 and the second accommodation slot 231. In addition, the two opposite sides (left and right sides) of the body 10 have a pivot portion 11, and the pivot piece 23 is assembled to the pivot portion 11 by the pivot hole 232, so that the support arm set 21 and the audio element 22 may rotate relative to the body 10.

In some embodiments, the pivot piece 23 may also be directly disposed on a surface of the audio element 22 facing the body 10. That is, the pivot piece 23 and a housing of the audio element 22 are an integrated structure, and the support arm set 21 may also be connected to the two opposite sides of the body 10 by the pivot piece 23. In some embodiments, the two audio elements 22 may also be respectively disposed between the first end portion 212 and one of the two pivot pieces 23 and between the second end portion 213 and another of the two pivot pieces 23 in a pivot manner. In other words, one side of the audio element 22 has a pivot or other rotatable structures, to connect to the first end portion 212 and the second end portion 213 of the support arm set 21, and the other side is connected to the two opposite sides of the body 10 through the pivot pieces 23. Through the foregoing structure, the audio elements 22 may respectively rotate relative to the body 10, and the first end portion 212 and the second end portion 213 of the support arm set 21.

As shown in FIG. 1 and FIG. 2, the audio element 22 of this embodiment has a sound guide hole 221. The sound guide hole 221 of this embodiment faces the overlapping region 211 of the support arm set 21, and faces an ear of the user, as shown in FIG. 3A. Preferably, the sound guide hole 221 is in communication with the outside. For example, an opening 2141 corresponding to the sound guide hole 221 may be disposed at the first accommodation slot 214 or the second accommodation slot 231, so that the sound guide hole 221 is in communication with the outside. The first accommodation slot 214 of this embodiment has the opening 2141, and the second accommodation slot 231 has no structure for blocking the sound guide hole 221, so that the sound guide hole 221 may be in communication with the outside.

In other embodiments, a channel passing through the first accommodation slot 214 and the second accommodation slot 231 may also be formed on the audio element 22, so that the sound guide holes 221 are exposed in the first accommodation slot 214 and the second accommodation slot 231, and the sound guide hole 221 may also be in communication with the outside. After the user wears the HMD device 1, because the sound guide holes 221 face ears of the user, sound may be clearly transmitted to the ears of the user. In addition, the support arm set 21 is connected to the body 10 through the pivot pieces 23, and directions of the sound guide holes 221 may further be adjusted by rotating the support arm set 21, to match ear positions or usage habits of different users. In the embodiments in which the first accommodation slot 214 is an independent component, the directions of the sound guide holes 221 may be adjusted by rotating the first accommodation slot 214.

In addition, the audio element 22 of this embodiment is directly disposed outside the body 10, so that sound may be directly transmitted to the ears of the user. Compared with a conventional HMD in which sound needs to be transmitted through additional sound guide elements, the HMD device 1 of this embodiment can effectively transmit sound. In addition, the HMD device 1 of this embodiment does not need to be additionally provided with sound guide elements, thereby saving manufacturing and use of materials, to save costs.

Figure 4:
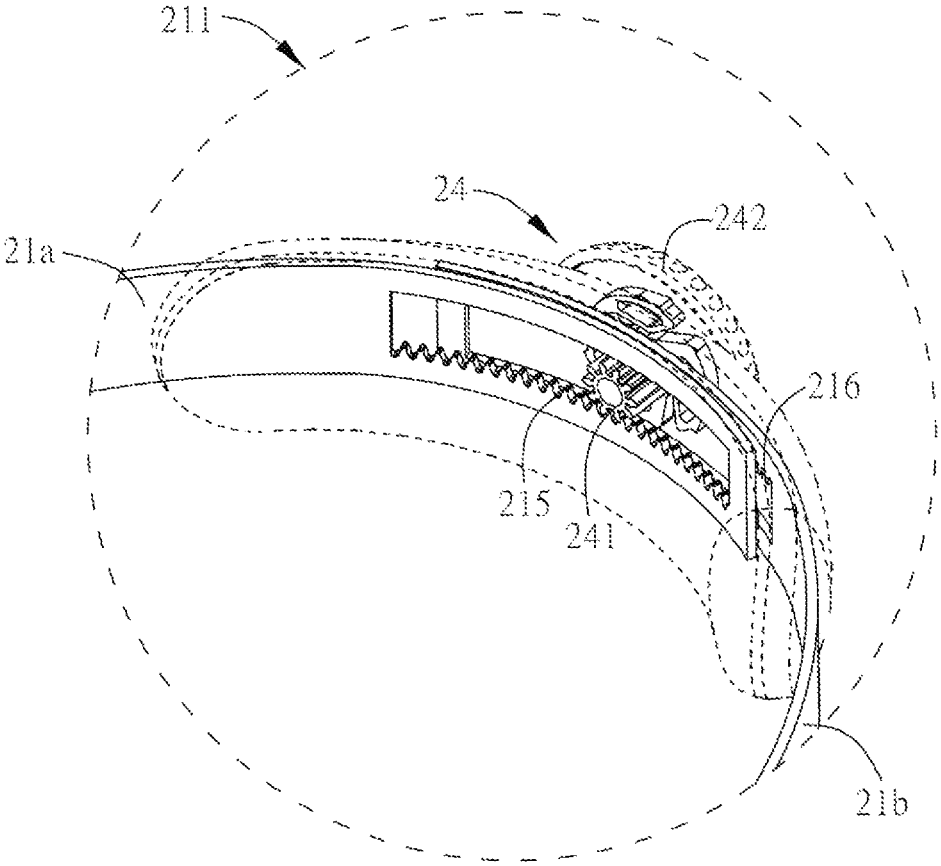
FIG. 4 is an enlarged schematic diagram of an overlapping region shown in FIG. 2.

As shown in FIG. 2, the fixing assembly 20 of this embodiment further includes an adjustment mechanism 24 disposed in the overlapping region 211 of the support arm set 21, to adjust the overall length of the support arm set 21. FIG. 4 is an enlarged schematic diagram of the overlapping region shown in FIG. 2. Specifically, the adjustment mechanism 24 includes a gear 241 and a knob 242, and the knob 242 is connected to the gear 241 and configured to drive the gear 241. The support arm set 21 of this embodiment is formed by two bandages. A bandage having the first end portion 212 is referred to as a first arm 21*a*, and a bandage having the second end portion 213 is referred to as a second arm 21*b*. In addition, the first arm 21*a* further has a first gear rack portion 215, and the first gear rack portion 215 is located at an end of the first arm 21*a* opposite to the first end portion 212, that is, the first end portion 212 and the first gear rack portion 215 are located at two opposite ends of the first arm 21*a*. The second arm 21*b* further has a second gear rack portion 216, and the second gear rack portion 216 is located at an end of the second arm 21*b* opposite to the second end portion 213, that is, the second end portion 213 and the second gear rack portion 216 are located at two opposite ends of the second arm 21*b*. In brief, the support arm set 21 includes the first arm 21*a* and the second arm 21*b*, the first arm 21*a* has the first end portion 212 and a first gear rack portion 215, and the second arm 21*b* has the second end portion 213 and the second gear rack portion 216.

Positions of the first gear rack portion 215 and the second gear rack portion 216 are close to the gear 241, so that at least a part of the first gear rack portion 215 and at least a part of the second gear rack portion 216 are located at the overlapping region 211 and overlap each other and are engaged with the gear 241. For example, the first gear rack portion 215 and the second gear rack portion 216 are respectively located at upper and lower sides of the gear 241. When the gear 241 rotates, the first gear rack portion 215 and the second gear rack portion 216 may be driven to move relatively, to change an overlapping length of the first gear rack portion 215 and the second gear rack portion 216, to adjust the overall length of the support arm set 21. For example, description is made from the perspective of FIG. 4. When the gear 241 rotates clockwise, the gear 241 drives the first gear rack portion 215 to move to the left, and drives the second gear rack portion 216 to move to the right, thereby reducing an overlapping part of the first gear rack portion 215 and the second gear rack portion 216, to increase the overall length of the support arm set 21. Otherwise, when the gear 241 rotates counterclockwise, the gear 241 drives the first gear rack portion 215 to move to the right, and drives the second gear rack portion 216 to move to the left, thereby increasing the overlapping part of the first gear rack portion 215 and the second gear rack portion 216, to reduce the overall length of the support arm set 21. Therefore, the user may rotate the gear 241 by rotating the knob 242, to adjust the overall length of the support arm set 21 for users with different head circumferences. In other embodiments, in addition to the support arm set 21, the fixing assembly 20 further includes a headband connected to the overlapping region 211 of the body 10 and the support arm set 21, to assist in wearing the HMD device 1 on the head of the user.

Based on the above, because the sound guide holes of the audio element face ears of the user, sound may be clearly transmitted to the ears of the user, and the support arm set is connected to the body through the pivot pieces, so that directions of the sound guide holes may further be adjusted by rotating the support arm set, to match ear positions or usage habits of different users. Moreover, the user may also rotate the gear by rotating the knob, to adjust the overall length of the support arm set.

It should be noted that the foregoing embodiments are examples for facilitating description, and the scope of right claimed by the application should be subject to the claims of this application, and is not limited to the foregoing embodiments.

What is claimed is:

1. A virtual reality (VR) head-mounted display (HMD) device, worn on a head of a user, the VR HMD device comprising:
   - a body; and
   - a fixing assembly, comprising:
     - a support arm set, having a first end portion, a second end portion and two first accommodation slots, wherein the first end portion and the second end portion are respectively located on two opposite sides of the body, and the two first accommodation slots are respectively located at the first end portion and the second end portion;
     - two pivot pieces, respectively connected to the first end portion and the second end portion, and respectively pivotally connected to the two opposite sides of the body; and
     - two audio elements, respectively disposed in the two first accommodation slots, and respectively disposed between the first end portion and one of the two pivot pieces and between the second end portion and another of the two pivot pieces, wherein each of the two audio elements has a sound guide hole, and a position of the sound guide hole faces an ear of the user.

2. The VR HMD device according to claim 1, wherein the fixing assembly further comprises an adjustment mechanism, the support arm set has an overlapping region, the overlapping region is located between the first end portion and the second end portion, and the adjustment mechanism is disposed on the overlapping region, to adjust an overall length of the support arm set.

3. The VR HMD device according to claim 2, wherein the adjustment mechanism comprises a gear, the support arm set comprises a first arm and a second arm, the first arm has the first end portion and a first gear rack portion, the second arm has the second end portion and a second gear rack portion, and at least a part of the first gear rack portion and at least a part of the second gear rack portion are located at the overlapping region and overlap each other and are engaged with the gear.

4. The VR HMD device according to claim 3, wherein when the gear rotates, the first gear rack portion and the second gear rack portion are driven to move relatively, to change an overlapping length of the first gear rack portion and the second gear rack portion, to adjust the overall length of the support arm set.

5. The VR HMD device according to claim 3, wherein the first gear rack portion is located at an end of the first arm opposite to the first end portion, and the second gear rack portion is located at an end of the second arm opposite to the second end portion.

6. The VR HMD device according to claim 3, wherein the adjustment mechanism further comprises a knob connected to the gear and configured to drive the gear.

7. The VR HMD device according to claim 1, wherein each of the pivot pieces has a second accommodation slot corresponding to the first accommodation slot, each of the two audio elements is accommodated in the first accommodation slot and the second accommodation slot, and the sound guide hole is in communication with the outside.

8. The VR HMD device according to claim 7, wherein the first accommodation slot or the second accommodation slot has an opening, and the opening is in communication with the sound guide hole.

9. The VR HMD device according to claim 7, wherein each of the two opposite sides of the body comprises a pivot portion, each of the pivot pieces comprises a pivot hole, and the pivot piece is assembled to the pivot portion by the pivot hole.

10. The VR HMD device according to claim 1, wherein the two audio elements are respectively disposed between the first end portion and one of the two pivot pieces and between the second end portion and another of the two pivot pieces in a pivot manner, so that the two audio elements respectively rotate relative to the first end portion and the second end portion.

11. The VR HMD device according to claim 10, wherein each of the two opposite sides of the body comprises a pivot portion, each of the pivot pieces comprises a pivot hole, and the pivot piece is assembled to the pivot portion by the pivot hole.

12. A virtual reality (VR) head-mounted display (HMD) device, worn on a head of a user, the VR HMD device comprising:

a body; and a fixing assembly, comprising:

a support arm set, having a first end portion and a second end portion respectively located on two opposite sides of the body;

two pivot pieces, respectively connected to the first end portion and the second end portion, and respectively pivotally connected to the two opposite sides of the body; and two audio elements, respectively disposed between the first end portion and one of the two pivot pieces and between the second end portion and another of the two pivot pieces in a pivot manner, so that the two audio elements respectively rotate relative to the first end portion and the second end portion, wherein each of the two audio elements has a sound guide hole, and a position of the sound guide hole faces an ear of the user.

* * * * *